US010161667B1

(12) United States Patent
Besore et al.

(10) Patent No.: US 10,161,667 B1
(45) Date of Patent: Dec. 25, 2018

(54) REFRIGERATOR APPLIANCE HAVING A DEFROST CHAMBER

(71) Applicant: Haier US Appliance Solutions, Inc., Wilmington, DE (US)

(72) Inventors: John Keith Besore, Prospect, KY (US); Brent Alden Junge, Evansville, IN (US); Bradley Nicholas Gilkey, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/813,219

(22) Filed: Nov. 15, 2017

(51) Int. Cl.
*F25D 21/00* (2006.01)
*F25D 21/08* (2006.01)
*F25D 25/02* (2006.01)

(52) U.S. Cl.
CPC ..... *F25D 21/006* (2013.01); *F25D 21/08* (2013.01); *F25D 25/025* (2013.01); *F25D 2400/02* (2013.01); *F25D 2600/04* (2013.01)

(58) Field of Classification Search
CPC .... F25D 21/006; F25D 21/08; F25D 2400/02; F25D 2600/04; H05B 6/688; H05B 6/645; H05B 6/664
See application file for complete search history.

(56) References Cited

U.S. PATENT DOCUMENTS 2,773,162 A * 12/1956 Christensen ..... B64D 15/12 219/203
4,296,299 A * 10/1981 Stottmann ..... H05B 6/62 219/771
4,303,820 A * 12/1981 Stottmann ..... H05B 6/62 219/771
4,333,521 A * 6/1982 Stottman ..... H05B 6/62 165/63
5,019,804 A * 5/1991 Fraden ..... G08B 13/26 327/509
5,561,586 A * 10/1996 Tomohiro ..... H01G 4/385 333/172
6,247,395 B1 6/2001 Yamamoto
(Continued)

FOREIGN PATENT DOCUMENTS

CN 106288626 A * 1/2017
JP H10134953 A 5/1998
(Continued)

*Primary Examiner* — Kun Kai Ma
(74) *Attorney, Agent, or Firm* — Dority & Manning, P.A.

(57) ABSTRACT

A refrigerator appliance having a defrost chamber is provided herein. The refrigerator appliance may include a cabinet defining a chilled chamber, a defrost drawer housing, and a pair of electromagnetic electrodes. The defrost drawer housing may be mounted within the chilled chamber and define the defrost chamber for the receipt of a food item. The pair of electromagnetic electrodes may be spaced apart along a vertical direction within the drawer housing. Each electromagnetic electrode may include a first heating ring and a second heating ring that is larger than the first heating ring. Each electromagnetic electrode may also include a conductive path and an electrical restrictor element. The conductive path may extend between the first heating ring and the second heating ring. The electrical restrictor element may be coupled to the conductive path and selectively permit a current therethrough.

20 Claims, 6 Drawing Sheets

(56) References Cited

U.S. PATENT DOCUMENTS 6,657,173 B2 12/2003 Flugstad et al.
9,078,298 B2 7/2015 Ben-Shmuel et al.
9,876,481 B2 * 1/2018 Omori ..... H05B 6/70
2003/0010453 A1 * 1/2003 Tanaka ..... H01J 37/32082 156/345.38
2003/0080094 A1 * 5/2003 Imai ..... B23H 7/26 219/69.11
2004/0012683 A1 * 1/2004 Yamasaki ..... H04N 5/23248 348/208.1
2006/0174715 A1 * 8/2006 Wehrs ..... G01F 1/588 73/861.12
2007/0046307 A1 * 3/2007 Itakura ..... G01R 31/2865 324/750.03
2007/0056952 A1 * 3/2007 Itakura ..... H05B 3/26 219/444.1
2007/0082313 A1 * 4/2007 Itakura ..... G01R 31/2863 432/227
2007/0152586 A1 * 7/2007 Moon ..... H01J 11/12 313/582
2007/0226994 A1 * 10/2007 Wollach ..... C25D 5/022 29/825
2008/0152333 A1 * 6/2008 Yamasaki ..... G02B 27/646 396/55
2009/0262041 A1 * 10/2009 Ikemoto ..... G06K 19/07749 343/860
2010/0060300 A1 * 3/2010 Muller ..... A61B 5/0408 324/686
2010/0109804 A1 * 5/2010 Feichtinger ..... H01C 7/10 333/172
2010/0156750 A1 * 6/2010 Ishibashi ..... H01Q 1/40 343/873
2010/0310383 A1 * 12/2010 Tanaka ..... F04B 37/02 417/48
2011/0230747 A1 * 9/2011 Rogers ..... A61B 5/05 600/377
2015/0212026 A1 * 7/2015 Pluta ..... G01N 27/02 702/65
2018/0042073 A1 * 2/2018 Scott ..... H05B 6/645
2018/0042074 A1 * 2/2018 Qiu ..... H03H 7/40

FOREIGN PATENT DOCUMENTS

WO WO-2016033906 A1 * 3/2016 ..... F25D 23/12
WO WO-2016132260 A1 * 8/2016 ..... H05B 6/105

* cited by examiner

REFRIGERATOR APPLIANCE HAVING A DEFROST CHAMBER

FIELD OF THE INVENTION

The present subject matter relates generally to refrigerator appliances and more particularly to refrigerator appliances having one or more features for defrosting food items therein.

BACKGROUND OF THE INVENTION

Various methods are presently available to defrost frozen food items. However, these presently available methods to defrost food items generally suffer from certain drawbacks. As an example, frozen food items can be left on a countertop for an extended period of time in order to thaw the food items. While exposed to ambient conditions on the countertop, the food items can enter a food "danger zone" and harmful bacteria can grow within the food items. As another example, frozen food items can be heated in a microwave appliance operating a relatively high frequency [e.g., between 915 and 2450 megahertz (MHz)] in order to thaw the food items. However, heating the food items within the microwave appliance can also partially cook the food items and can negatively affect the taste or texture of the food items. As yet another example, frozen food items can be placed within a fresh food chamber of a refrigerator appliance in order to thaw the food items. Defrosting food items within the fresh food chamber can be time consuming and inconvenient.

Certain items exist for facilitating thawing within a refrigerator appliance. Generally, such items supply additional heat to a portion of the refrigerator appliance in which frozen food items are placed. This additional heat may serve to accelerate the food items. However, such systems are often inefficient. The supply of heat is not narrowly tailored to the food items to be thawed. Moreover, supplying the correct amount of heat is often difficult. Excessive heat may begin cooking the food items, negatively affecting taste or texture. Insufficient heat may fail to adequately thaw the food items, or may take an undesirably long time to completely defrost the food items. If heat is localized to an area too small for the item being defrosted, thawing may be non-uniform.

Accordingly, a refrigerator appliance having features for conveniently defrosting frozen food items would be useful. In particular, a refrigerator appliance that could selectively vary defrosting would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet defining a chilled chamber, a defrost drawer housing, and a pair of electromagnetic electrodes. The defrost drawer housing may be mounted within the chilled chamber. The defrost drawer housing may define an enclosed defrost chamber for the receipt of a food item. The pair of electromagnetic electrodes may be spaced apart along a vertical direction within the drawer housing. Each electromagnetic electrode may include a first heating ring and a second heating ring that is larger than the first heating ring. Each electromagnetic electrode may also include a conductive path and an electrical restrictor element. The conductive path may extend between the first heating ring and the second heating ring. The electrical restrictor element may be coupled to the conductive path and selectively permit a current therethrough.

In another exemplary aspect of the present disclosure, a refrigerator appliance is provided. The refrigerator appliance may include a cabinet defining a chilled chamber, a defrost drawer housing, a pair of electromagnetic electrodes, and a controller. The defrost drawer housing may be mounted within the chilled chamber. The defrost drawer housing may define an enclosed defrost chamber for the receipt of a food item. The pair of electromagnetic electrodes may be spaced apart along a vertical direction within the drawer housing. Each electromagnetic electrode may include a first heating ring and a second heating ring that is concentrically positioned about the first heating ring. The second heating ring may be larger than the first heating ring. Each electromagnetic electrode may also include a conductive path and an electrical restrictor element. The conductive path may extend between the first heating ring and the second heating ring. The electrical restrictor element may be coupled to the conductive path and selectively permit a current therethrough. The controller operably may be coupled to the pair of electromagnetic electrodes. The controller may be configured to direct the current through the electrical restrictor element based on a set heating size.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
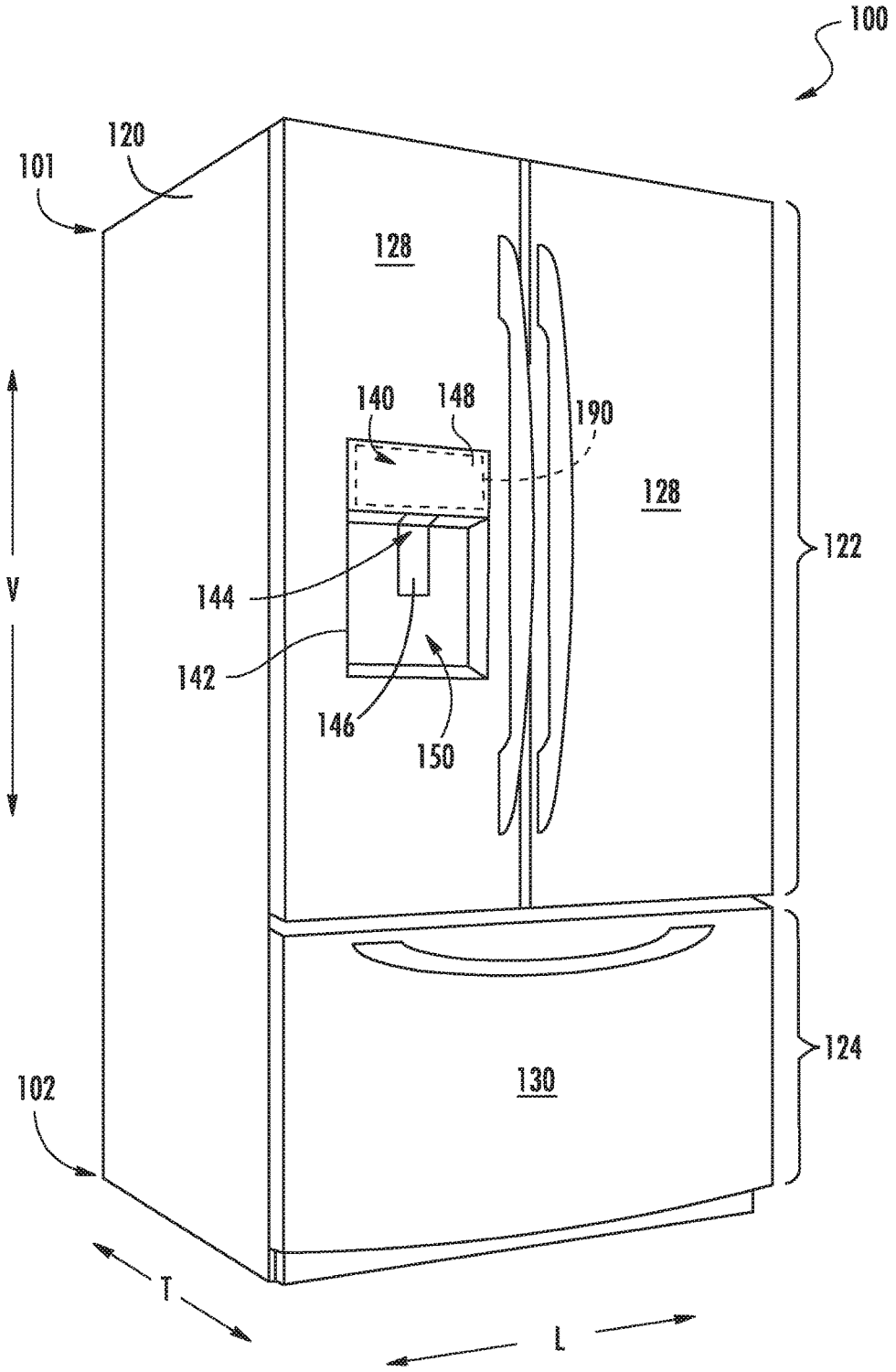
FIG. 1 provides a perspective view of a refrigerator appliance according to example embodiments of the present disclosure.

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present subject matter. The term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
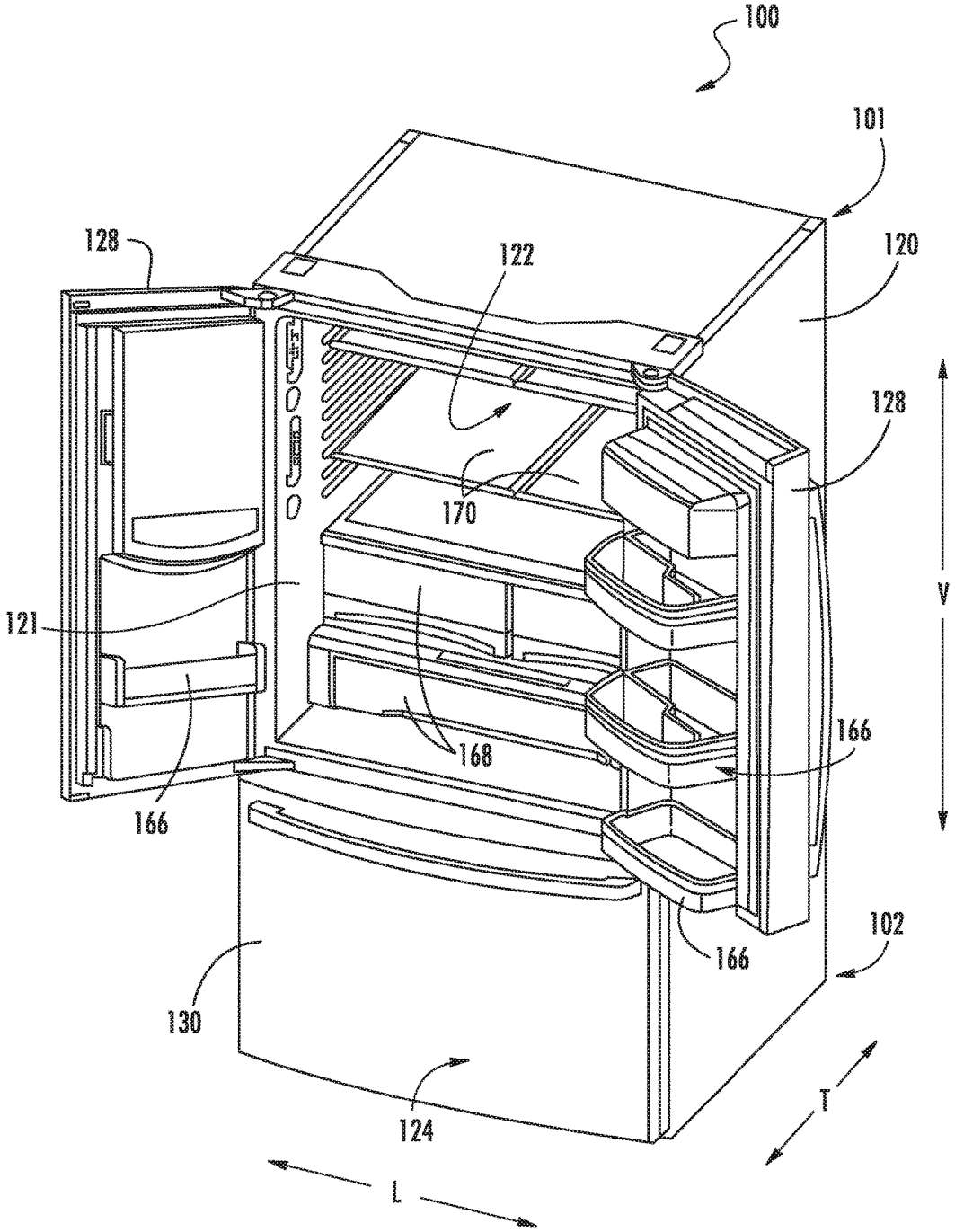
FIG. 2 provides a perspective view of the example refrigerator appliance of FIG. 1, wherein refrigerator doors of the refrigerator appliance are in an open position to reveal a fresh food chamber of the refrigerator appliance.

Turning now to the figures, FIGS. 1 and 2, FIG. 1 provides a perspective view of a refrigerator appliance 100 according to an example embodiment of the present disclosure. FIG. 2 provides a perspective view of refrigerator appliance 100 having multiple refrigerator doors 128 in the open position. As shown, refrigerator appliance 100 includes a housing or cabinet 120 that extends between a top 101 and a bottom 102 along a vertical direction V. Cabinet 120 also extends along a lateral direction L and a transverse direction T, each of the vertical direction V, lateral direction L, and transverse direction T being mutually perpendicular to one another. In turn, vertical direction V, lateral direction L, and transverse direction T define an orthogonal direction system.

Cabinet 120 includes a liner 121 that defines chilled chambers for receipt of food items for storage. In particular, liner 121 defines a fresh food chamber 122 positioned at or adjacent top 101 of cabinet 120 and a freezer chamber 124 arranged at or adjacent bottom 102 of cabinet 120. As such, refrigerator appliance 100 is generally referred to as a bottom mount refrigerator. It is recognized, however, that the benefits of the present disclosure apply to other types and styles of appliances such as, e.g., a top mount refrigerator appliance, a side-by-side style refrigerator appliance, or a range appliance. Consequently, the description set forth herein is for illustrative purposes only and is not intended to be limiting in any aspect to any particular refrigerator chamber configuration.

Refrigerator doors 128 are rotatably hinged to an edge of cabinet 120 for selectively accessing fresh food chamber 122. In addition, a freezer door 130 is arranged below refrigerator doors 128 for selectively accessing freezer chamber 124. Freezer door 130 is attached to a freezer drawer (not shown) slidably mounted within freezer chamber 124. Refrigerator doors 128 and freezer door 130 are shown in the closed configuration in FIG. 1.

In some embodiments, refrigerator appliance 100 also includes a dispensing assembly 140 for dispensing liquid water or ice. Dispensing assembly 140 includes a dispenser 142 positioned on or mounted to an exterior portion of refrigerator appliance 100 (e.g., on one of refrigerator doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button (e.g., for selecting a desired mode of operation such as crushed or non-crushed ice).

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128.

Operation of the refrigerator appliance 100 can be generally controlled or regulated by a controller 190. As will be described in greater detail below, controller 190 may include multiple modes of operation or sequences that control or regulate various portions of refrigerator appliance 100 according to one or more discrete criteria.

In some embodiments, controller 190 is operably coupled (e.g., electrically coupled or wirelessly coupled) to user interface panel 148 or various other components, as will be described below. User interface panel 148 provides selections for user manipulation of the operation of refrigerator appliance 100. As an example, user interface panel 148 may provide for selections between whole or crushed ice, chilled water, or specific operations, such as a defrost routine. In response to one or more input signals (e.g., from user manipulation of user interface panel 148 or one or more sensor signals), controller 190 may operate various components of the refrigerator appliance 100.

Controller 190 may include a memory (e.g., non-transitive media) and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes programming instructions stored in memory. For certain embodiments, the instructions include a software package configured to operate appliance 100 and, for example, execute a defrost routine including the exemplary method 600 described below with reference to FIG. 6. The memory may be a separate component from the processor or may be included onboard within the processor. Alternatively, controller 190 may be constructed without using a microprocessor (e.g., using a combination of discrete analog and/or digital logic circuitry (such as switches, amplifiers, integrators, comparators, flip-flops, AND gates, and the like) to perform control functionality instead of relying upon software.

Controller 190, or portions thereof, may be positioned in a variety of locations throughout refrigerator appliance 100. In example embodiments, controller 190 is located within the user interface panel 148. In other embodiments, the controller 190 may be positioned at any suitable location within refrigerator appliance 100, such as within a fresh food chamber, a freezer door, etc. In additional or alternative embodiments, controller 190 is formed from multiple components mounted at discrete locations within or on refrigerator appliance 100. Input/output ("I/O") signals may be routed between controller 190 and various operational components of refrigerator appliance 100. For example, user interface panel 148 may be operably coupled (e.g., electrically coupled) to controller 190 via one or more signal lines or shared communication busses.

According to the illustrated embodiment, various storage components are mounted within fresh food chamber 122 to facilitate storage of food items therein as will be understood by those skilled in the art. In particular, the storage components include storage bins 166, drawers 168, and shelves 170 that are mounted within fresh food chamber 122. Storage bins 166, drawers 168, and shelves 170 are configured for receipt of food items (e.g., beverages or solid food items) and may assist with organizing such food items. As an example, drawers 168 can receive fresh food items (e.g., vegetables, fruits, and/or cheeses) and increase the useful life of such fresh food items. As another example, one or more drawers 168 can be provided as part of a defrost assembly to receive frozen food items (e.g., frozen meats, soups, etc.), which is described in detail below.

Figure 3:
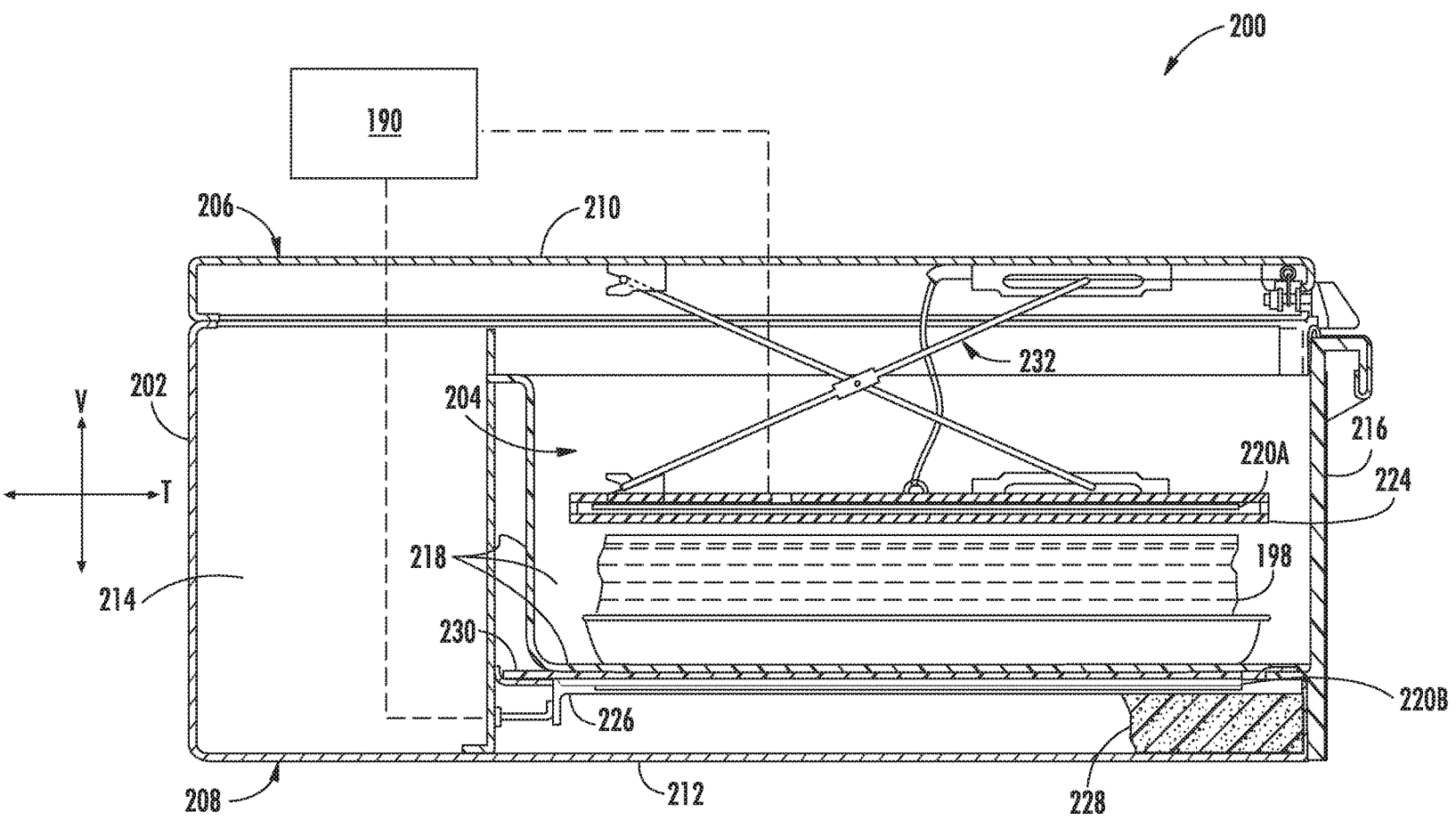
FIG. 3 provides a cross-sectional, side view of a defrost assembly for a refrigerator appliance according to exemplary embodiments of the present disclosure.

Turning now to FIG. 3, an exemplary defrost assembly 200 is illustrated. As shown, in some embodiments, defrost assembly 200 includes a defrost drawer housing 202 for receiving items within an enclosed drawer chamber 204. It is understood that defrost drawer housing 202 may be provided with, or in place of, a drawer (e.g., drawers 168) within fresh food chamber 122 or freezer chamber 124.

As may be seen in FIG. 3, defrost drawer housing 202 generally extends between a top portion 206 and a bottom portion 208 (e.g., along the vertical direction V). A top wall 210 of drawer housing 202 is positioned at or adjacent top portion 206 of drawer housing 202, and a bottom wall 212 of defrost drawer housing 202 is positioned at or adjacent bottom portion 208 of defrost drawer housing 202. Thus, top and bottom walls 210, 212 of defrost drawer housing 202 may be spaced apart from each other (e.g., along the vertical direction V). Defrost drawer housing 202 also includes side walls 214 that extend between top and bottom walls 210, 212 of defrost drawer housing 202 (e.g., along the vertical direction V). Top wall 210, bottom wall 212 and side walls 214 may assist with defining defrost chamber 204 of defrost drawer housing 202.

Defrost drawer housing 202 also includes a door 216 that permits selective access to defrost chamber 204 of defrost drawer housing 202. For instance, door 216 may be provided as a slidable drawer having one or more mutually-fixed panels 218 defining a sub-compartment that may be positioned inside of drawer chamber 204 and within which one or more food items 198 may be placed. In turn, door 216, including panels 218, may slide (e.g., along the transverse direction T) between an open position permitting access to drawer chamber 204 and closed position restricting access to drawer chamber 204. Nonetheless, it is understood that other configurations of door 216 may be provided (e.g., as an outward pivoting door, upward pivoting door, independently slidable door, etc.) to selectively open and close drawer chamber 204.

In certain embodiments, defrost drawer housing 202 (e.g., top wall 210, bottom wall 212, and side walls 214 of defrost drawer housing 202) is insulated such that drawer chamber 204 of defrost drawer housing 202 and food items 198 positioned therein may be heated (e.g., without significantly heating fresh food chamber 122 or freezer chamber 124). As an example, top wall 210, bottom wall 212, or side walls 214 of defrost drawer housing 202 may include vacuum insulation panels, insulating foam, fiberglass insulation, etc. to assist with insulating defrost drawer housing 202. Thus, drawer chamber 204 of defrost drawer housing 202 may be thermally isolated from fresh food chamber 122 or freezer chamber 124 within which drawer housing 202 is mounted. Moreover, heat transfer between drawer chamber 204 of defrost drawer housing 202 and fresh food chamber 122 or freezer chamber 124 may be limited or hindered by defrost drawer housing 202.

A pair of electromagnetic electrodes (e.g., a top electrode 220A and a bottom electrode 220B) is generally positioned within drawer housing 202. In particular, top electrode 220A is spaced apart from bottom electrode 220B (e.g., along the vertical direction V) within drawer chamber 204. In some such embodiments, top and bottom electrodes 220A, 220B are supported by separate planar members. For instance, top electrode 220A may be fixed to (e.g., directly on or within) an upper platen 224 below top wall 210. Bottom electrode 220B may be fixed to (e.g., directly on or within) a lower platen 226 above bottom wall 212. Optionally, lower platen 226 may rest on a supporting insulator material 228 that fills the space between bottom wall 212 and lower platen 226 (e.g., beneath panels 218). Additionally or alternatively, lower platen 226 may be further separated from panel by a shelf 232 formed of any suitable low loss dielectric material, such as a glass-ceramic material.

In some embodiments, the space (e.g., vertical space) between top electrode 220A and bottom electrode 220B is variable. A vertical lift 232 may act to move upper platen 224 within the drawer housing 202 (e.g., parallel to lower platen 226) between multiple positions of varying proximity to bottom wall 212 or lower platen 226. In the exemplary embodiments of FIG. 3, vertical lift 232 is generally provided as a scissor jack. However, it is understood that any other suitable actuating assembly (e.g., linear actuator, pulley system, rack and pinion, etc.) may be provided to move upper platen 224 or top electrode 220A along the vertical direction V.

As generally illustrated, top electrode 220A and bottom electrode 220B are each operably coupled (e.g., electrically coupled via one or more conductive signal lines or busses) to controller 190. Together, top electrode 220A and bottom electrode 220B may form a radio frequency (RF) heating pair. In turn, controller 190 may be configured to direct an electric current [e.g., RF current between 10 and 100 megahertz (MHz)] between top electrode 220A and bottom electrode 220B. As is generally understood, the electric current may induce an electric field to heat or defrost food items 198 (e.g., consumable high loss dielectric materials) positioned between top electrode 220A and bottom electrode 220B.

Figure 4:
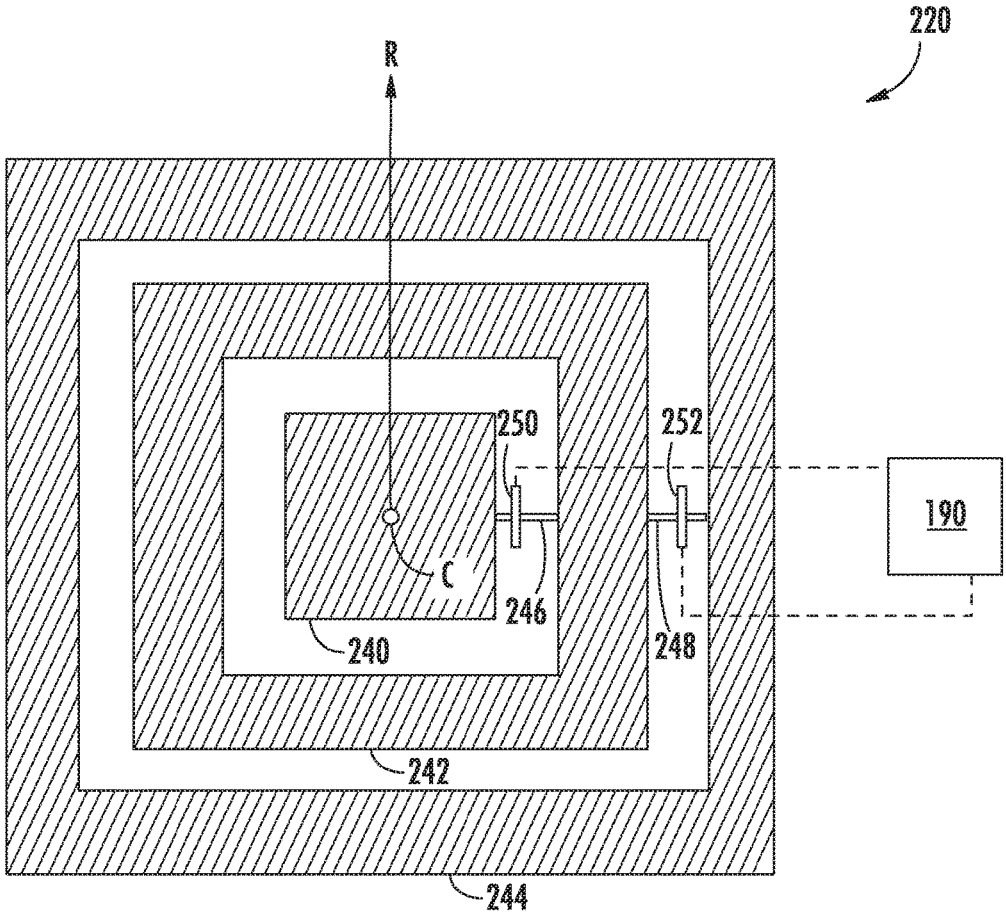
FIG. 4 provides a schematic view of a portion of a defrost assembly according for a refrigerator appliance according to exemplary embodiments of the present disclosure.

Generally, each electromagnetic electrode 220A, 220B may be provided as matched or corresponding bodies. In turn, the shape or structure of top electrode 220A may mirror the shape or structure of bottom electrode 220B. As illustrated in FIG. 4, each electromagnetic electrode 220 may include multiple conductive heating rings (e.g., heating rings 240, 242, 244) electrically connected by one or more conductive paths 246, 248. For instance, a first heating ring 240 of an electromagnetic electrode 220 may be surrounded (e.g., along a plane perpendicular to the vertical direction V) by a second heating ring 242. In other words, the second heating ring 242 may be positioned radially outward from a center point C of first heating ring 240. Thus, second heating ring 242 is larger (e.g., in diameter) than first heating ring 240. Optionally, one or more additional heating rings (e.g., a third heating ring 244) may be included around second heating ring 242. Thus, a third heating ring 244 may be larger (e.g., in diameter) than second heating ring 242.

Conductive heating rings (e.g., heating rings 240, 242, 244) may be generally provided as any suitable continuous shape. As used in the context of electromagnetic electrodes, the term "ring" may indicate a generally toroidal structure (e.g., a toroidal polyhedron having a single central hole, such as that illustrated at second heating ring 242) or a generally solid structure (e.g., a void-free polyhedron having no visible hole, such as that illustrated at first heating ring 240). Thus, as illustrated, conductive heating rings 240, 242, 244 may be generally formed about a center point C. In some such embodiments, each conductive heating ring 240, 242, 244 of electromagnetic electrode 220 is mutually-concentric such that a constant radial gap is defined between the perimeters of adjacent heating rings. As used in the context of heating rings, "adjacent" is understood to indicate a heating ring that is positioned immediately and sequentially inward or outward (e.g., along the radial direction R) from another heating ring. Thus, air or an insulating material may occupy the space between an outer radial edge of one heating ring (e.g., first heating ring 240) and an inner radial edge of a larger adjacent heating ring (e.g., second heating ring 242). Optionally, the radial gap between each adjacent concentric ring pair may be identical or, alternatively, unique.

A conductive path generally extends (e.g., through the radial gap) between adjacent heating rings (e.g., 240 and 242 or 242 and 244). Thus, as shown, a first conductive path 246 extends radially between first heating ring 240 and second heating ring 242; and a second conductive path 248 extends radially between second heating ring 242 and third heating ring 244. Each conductive path is formed from a conductive (e.g., electrically conductive) material such that an electrical current (e.g., RF current) may be conducted between adjacent heating rings.

In some embodiments, each electromagnetic electrode 220 includes one or more electrical restrictor elements (e.g., restrictor elements 250, 252). In particular, an electrical restrictor element (e.g., restrictor element 250 or 252) may be coupled to a corresponding conductive path (e.g., in series between adjacent heating rings 240 and 242 or 242 and 244).

Generally, each electrical restrictor element (e.g., restrictor elements 250, 252) is configured to selectively permit or restrict the electrical current through the corresponding conductive path (i.e., between adjacent heating rings). Thus, electrical restrictor element 250 or 252 may alternate between an opened and closed configuration. In the opened configuration, an electrical current or signal is prevented from flowing through the restrictor element and thereby the corresponding conductive path. In the closed configuration, an electrical current or signal is permitted to flow through the restrictor element and thereby the corresponding conductive path.

In certain embodiments, electrical restrictor element 250 or 252 is a gate switch (e.g., normally open switch, normally closed switch, etc.). Controller 190 may selectively direct the gate switch to open or close. In other embodiments, electrical restrictor element 250 or 252 is a narrow band pass filter, which limits electric currents therethrough to those above a predetermined frequency threshold (i.e., such that only currents having a frequency above the predetermined frequency threshold may pass through electrical restrictor element 250 or 252). In embodiments having multiple discrete electrical restrictor elements (e.g., restrictor elements 250 and 252) coupled to separate conductive paths (e.g., conductive paths 246 and 248), each electrical restrictor element (e.g., restrictor element 250 or 252) may be the same or, alternatively, unique from one or more of the other electrical restrictor elements (e.g., restrictor element 252 or 250). As an example, first restrictor element 250 may be a gate switch while second restrictor element 252 is a narrow band pass filter. Further electrical restrictor elements may be any suitable element.

As shown, a separate electrical restrictor element 250 or 252 may be coupled to each discrete conductive path 246 or 248. For instance, a first restrictor element 250 may be coupled to first conductive path 246 while a second restrictor element 252 is coupled to second conductive path 248. However, in alternative embodiments, certain conductive paths may not have any corresponding restrictor element and are, thus, generally unrestricted to permit an electrical current (e.g., RF current) between adjacent heating rings.

In some embodiments, controller 190 is configured to selectively direct a current to the pair of electromagnetic electrodes 220A, 220B (FIG. 3). For instance, as is understood, controller 190 may include an RF circuit (not pictured) to direct an RF current (e.g., between 10 MHz and 100 MHz) to top electrode 220A and bottom electrode 220B such that an alternating electric field heats a dielectric material (e.g., food items 198) positioned between top electrode 220A and bottom electrode 220B. Optionally, the controller 190 may vary its own operations based on the size (e.g., length or width perpendicular to the vertical direction V) of food items 198 to be defrosted. In certain embodiments, controller 190 is configured to selectively direct the RF current based on a set heating size. Transmission of the RF current from controller 190 through the pair of electromagnetic electrodes 220 may thus be contingent on or influenced by the set heating size.

Referring still to FIG. 4, in exemplary embodiments, the controller 190 is configured to separately direct the current flow through each electrical restrictor element 250, 252 based on the set heating size. Whether the RF current is permitted to certain heating rings (i.e., through an upstream electrical restrictor element) may be determined according to the set heating size. During use, the number of heating rings 240, 242, 244 that receive the RF current, and thus generate an electrical field, may be generally correlated to the set heating size. As the set heating size increase, so too might the number of heating rings 240, 242, 244 that receive the RF current. Advantageously, such defrost assemblies may ensure efficient defrosting and prevent or limit "runaway heat" where outer fringes of defrosting food items are overheated.

In exemplary embodiments, such as those wherein one or more electrical restrictor elements (e.g., first restrictor element 250 and second restrictor element 252) is a gate switch, controller 190 may be configured to open or close the gate switch according to the set heating size. As an example, at a first heating size, controller 190 may transmit the RF current and direct the first restrictor element 250 of each electromagnetic electrode 220 to be opened, breaking the circuit between the corresponding first heating ring 240 and second heating ring 242. Thus, the RF current is restricted to the first heating ring 240. At a second heating size that is larger than the first heating size, controller 190 may transmit the RF current and direct the first restrictor element 250 of each electromagnetic electrode 220 to be closed, connecting the circuit between the corresponding first heating ring 240 and second heating ring 242. Thus, the RF current is permitted to flow through both the first heating ring 240 and the second heating ring 242. Controller 190 may direct the second restrictor element 252 of each electromagnetic electrode 220 to be opened. At a third heating size that is larger than the second heating size, controller 190 may transmit the RF current and direct the first restrictor element 250 and second restrictor element 252 of each electromagnetic electrode 220 to be closed, connecting the circuit between the corresponding first heating ring 240, second heating ring 242, and third heating ring 244. Thus, the RF current is permitted to flow through each of the first heating ring 240, the second heating ring 242, and the third heating ring 244.

In further exemplary embodiments, such as those wherein one or more electrical restrictor elements (e.g., first restrictor element 250 and second restrictor element 252) is a narrow band filter, controller 190 may be configured to vary the frequency of the RF current according to the set heating size. In some such embodiments, the narrow bandpass filter of each first restrictor element 250 has a frequency threshold that is lower than the frequency threshold of the narrow bandpass filter of each second restrictor element 252. As an example, at a first heating size, controller 190 may transmit the RF current at a first frequency (e.g., 27 MHz) that is lower than the frequency threshold of the first restrictor element 250. Thus, the RF current is restricted to the first heating ring 240. At a second heating size that is larger than the first heating size, controller 190 may transmit the RF current at a second frequency (e.g., 32 MHz) that is greater than or equal to the frequency threshold of the first restrictor element 250 and less than the frequency threshold of the second restrictor element 252. Thus, the RF current is permitted to flow through both the first heating ring 240 and the second heating ring 242, while being restricted from passing to the third heating ring 244. At a third heating size that is larger than the second heating size, controller 190 may transmit the RF current at a second frequency (e.g., 43 MHz) that is greater than the frequency threshold of the first restrictor element 250 and that is greater than or equal to the frequency threshold of the second restrictor element 252. Thus, the RF current is permitted to flow through each of the first heating ring 240, the second heating ring 242, and the third heating ring 244.

In still further exemplary embodiments, such as those wherein at least one restrictor element (e.g., first restrictor element 250) is a gate switch and at least one other restrictor element (e.g., second restrictor element 252) is a narrow band filter, controller 190 may be configured to separately direct the current flow through each electrical restrictor element 250, 252 based on the set heating size. As an example, at a first heating size, controller 190 may transmit the RF current and direct the first restrictor element 250 of each electromagnetic electrode 220 to be opened, breaking the circuit between the corresponding first heating ring 240 and second heating ring 242. Thus, the RF current is restricted to the first heating ring 240. At a second heating size that is larger than the first heating size, controller 190 may transmit the RF current and direct the first restrictor element 250 of each electromagnetic electrode 220 to be closed, connecting the circuit between the corresponding first heating ring 240 and second heating ring 242. Thus, the RF current is permitted to flow through both the first heating ring 240 and the second heating ring 242. At the second heating size, controller 190 may transmit the RF current at a first frequency (e.g., 27 MHz) that is lower than the frequency threshold of the narrow band pass filter of the second restrictor element 252. At a third heating size that is larger than the second heating size, controller 190 may direct the first restrictor element 250 of each electromagnetic electrode 220 to be closed. Moreover, controller 190 may transmit the RF current at a second frequency (e.g., 32 MHz) that is greater than or equal to the frequency threshold of the second restrictor element 252. Thus, the RF current is permitted to flow through each of the first heating ring 240, the second heating ring 242, and the third heating ring 244.

Figure 5:
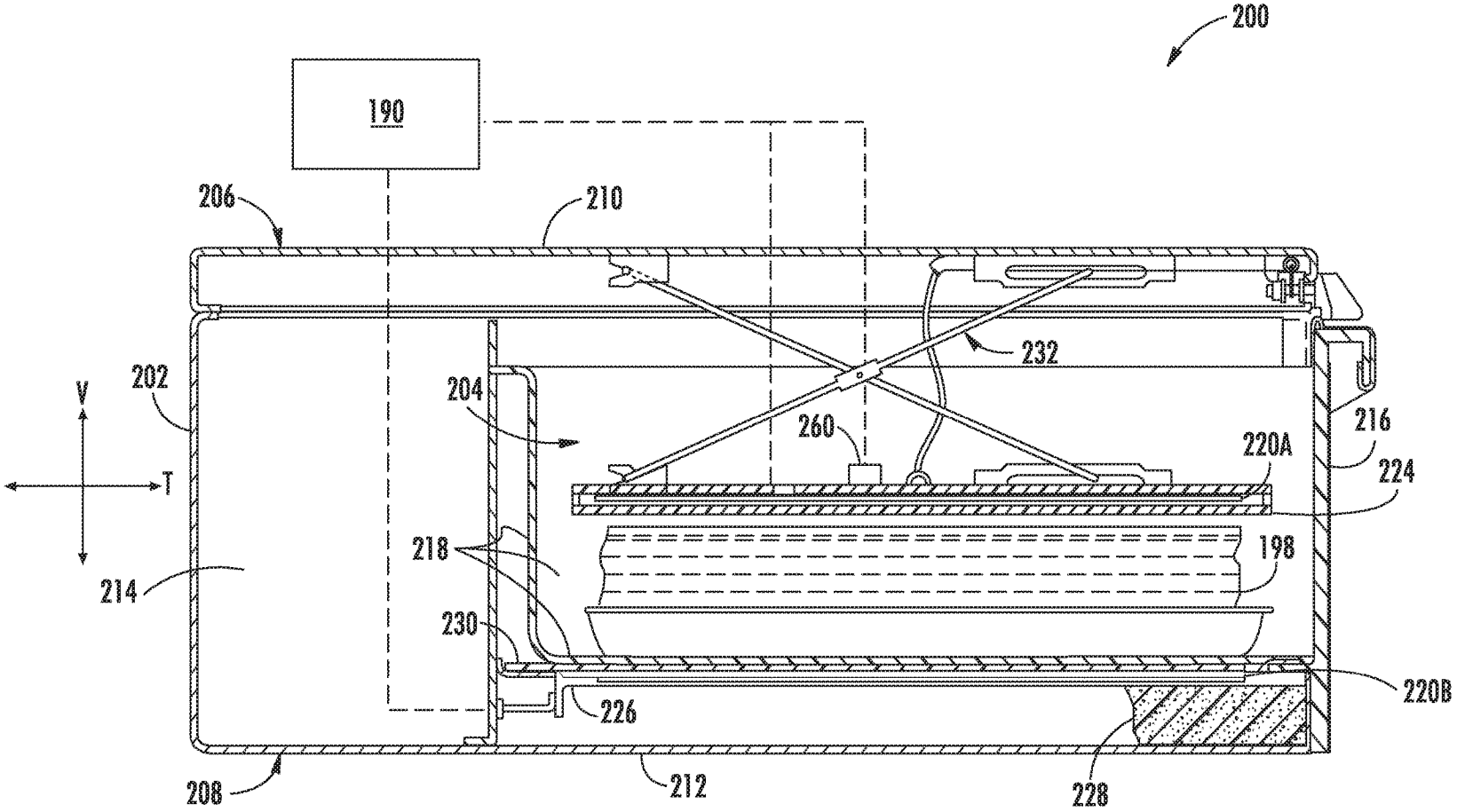
FIG. 5 provides a cross-sectional, side view of a defrost assembly for a refrigerator appliance according to exemplary embodiments of the present disclosure.

Referring to FIGS. 3 and 5, in some embodiments, controller 190 is further configured to determine the set heating size based on one or more received sizing signals. The heating size specified by the user may be a general estimation of relative size (e.g., small, medium, large, etc.) or may correspond to a measured geometric dimension (e.g., length, width, height, etc.).

As an example, a user may specify a certain heating size at the inputs of user interface panel 148, which may be transmitted from user interface panel 148 as a sizing signal. In turn, controller 190 may receive the sizing signal and direct the RF current accordingly.

As another example, the pair of electromagnetic electrodes (e.g., first electrode 220A and second electrode 220B) may detect an electric field before transmission of the RF current from controller 190. In particular, one or more of the electromagnetic electrodes 220A, 220B may detect variations in, for example, capacitance or resistance, across the heating rings 240, 242, 244. Such variations may be attributable to and indicative of food items 198 positioned between top electrode 220A and bottom electrode 220B (e.g., directly on top of lower platen 226). Moreover, the controller 190 may read or receive these variations as an electrical field signal, and from the received electrical field signal, automatically determine a desirable set heating size (e.g., without further user input).

As yet another example, a secondary sizing sensor 260 may be provided within drawer chamber 204, as illustrated in FIG. 5, and operably coupled to controller 190. Generally, secondary sizing sensor 260 may be any suitable discrete sensor for detecting one or more geometric dimensions (e.g., length, width, height, etc.) of food items 198 between top electrode 220A and bottom electrode 220B. For example, secondary sizing sensor 260 may include an infrared or optical sensor mounted to defrost assembly 200 (e.g., on top of upper platen 224 to detect an image of the space therebelow). In some such embodiments, the controller 190 is configured to receive the sizing signal (e.g., as an image signal) from secondary sizing sensor 260. Moreover, from the received sizing signal, controller 190 may automatically determine a desirable set heating size (e.g., without further user input).

Figure 6:
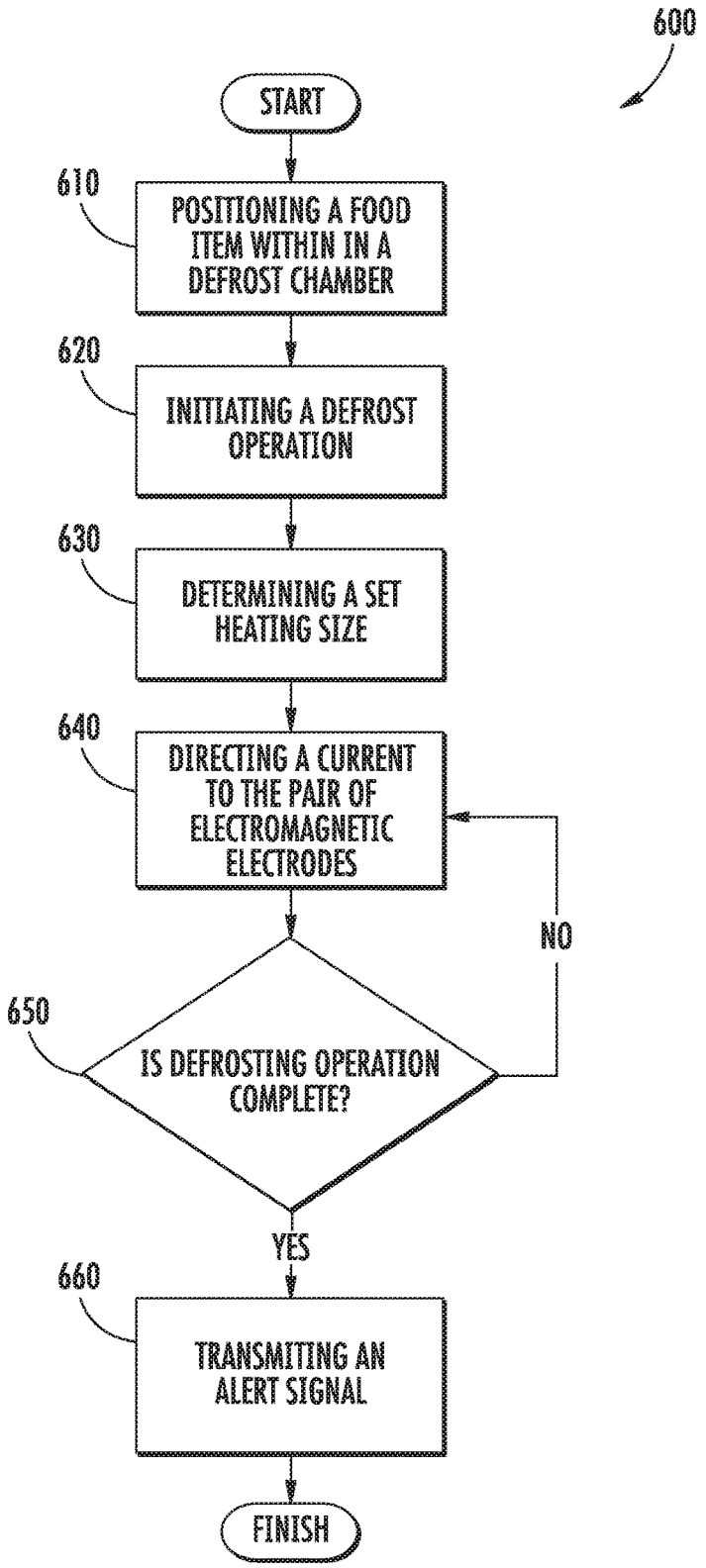
FIG. 6 provides a flow chart illustrating a method of operating a refrigerator appliance in accordance with example embodiments of the present disclosure.

Turning now to FIG. 6, a flow chart is provided of a method 600 according to exemplary embodiments of the present disclosure. Generally, the method 600 provides an exemplary defrost routine for any suitable refrigeration appliance, such as refrigerator appliance 100 (FIG. 1), described above (e.g., to defrost food items 198 within fresh food chamber 122). The method 600 can be performed, for instance, by the controller 190 (FIG. 1). As discussed above, controller 190 may be operably coupled to user interface panel 148. Moreover, controller 190 may be operably coupled to defrost assembly 200 at top electrode 220A and bottom electrode 220B, each of which includes one or more heating rings (e.g., heating rings 240, 242, 244) and restrictor elements (e.g., restrictor elements 250, 252) (FIGS. 3 and 5). Optionally, controller 190 may also be operably coupled to defrost assembly 200 at secondary sizing sensor 260 (FIG. 5). During operations, controller 190 may send signals to and receive signals from user interface panel 148 and defrost assembly 200. Controller 190 may further be operably coupled to other suitable components of the appliance 100 to facilitate operation of the appliance 100 generally.

FIG. 6 depicts steps performed in a particular order for purpose of illustration and discussion. Those of ordinary skill in the art, using the disclosures provided herein, will understand that the steps of any of the methods disclosed herein can be modified, adapted, rearranged, omitted, or expanded in various ways without deviating from the scope of the present disclosure, except as otherwise indicated.

At 610, the method 600 includes placing or positioning a food item within the defrost chamber of the defrost assembly. As an example, a user of the refrigerator appliance may place a frozen food item, such as chicken, soup, etc., within the defrost chamber. As discussed above, the defrost assembly is positioned or disposed within a chilled chamber, such as the fresh food chamber. Thus, a temperature of the defrost chamber may be about equal to (e.g., equal to) a temperature of the chilled chamber.

At 620, the method 600 includes initiating a defrost operation. As an example, a user of the refrigerator appliance may initiate the defrosting operation at 620 with the user interface panel.

Method 600 may also include establishing or ascertaining a desired completion time for the defrosting operation (e.g., at or before 620). For example, a user of the refrigerator appliance may utilize the user interface panel to manually input or establish the desired completion time for the defrosting operation to controller. Controller may be configured or programmed to initiate the defrosting operation at 620 such that the defrosting operation is complete and the food item within the defrost chamber of defrost assembly is suitably defrosted by the desired completion time for the defrosting operation (e.g., prior to a time a user of the refrigerator appliance would like to start cooking the food item within the defrost drawer chamber of drawer housing).

At 630, the method 600 includes determining a set heating size. In some embodiments, the set heating size at 630 is based on one or more received sizing signals, as described above. For instance, the received sizing signal may be a user-selected input signal transmitted from the user interface. Alternatively, the sizing signal may be automatically generated without any user input or estimation. As an example, the received sizing signal may be an electrical field signal detected at, and received from, one or both of the electromagnetic electrodes. As another example, the received signal may be received from a secondary sizing sensor (e.g., as an image signal), as described above. Optionally, 630 may be executed in response to initiating the defrost routine such that the set heating size is determined after (e.g., directly or indirectly after) 620.

At 640, the method includes directing a current (e.g., RF current) to the pair of electromagnetic electrodes based on the set heating size determined at 630. As described above, controller may separately direct the current flow through one or more electrical restrictor elements of each electromagnetic electrode (e.g., simultaneously). Generally, 640 may provide for increasing/decreasing the number of heating rings active (i.e., subject to the RF current) with the relative increase/decrease of the set heating size. As an example, if a gate switch is provided as a restrictor element, 640 may include selectively closing the gate switch based on the set heating size. As an additional or alternative example, if a narrow band filter is provided as a restrictor element, 640 may include selectively adjusting the frequency of the current based on the set heating size.

At 650, the method 600 includes determining whether the defrosting operation is complete. As an example, the controller may determine that the defrosting operation is complete if the period of the defrosting operation has elapsed. The defrosting operation is continued until the defrosting operation is complete at step 650.

When the defrosting operation is complete, the controller may alert (i.e., transmit an alert signal to) the user of refrigerator appliance at 660. Generally, the user may be alerted using any suitable method or mechanism at 660. As an example, the controller may present a message on display of refrigerator appliance at 660 to alert the user that the defrosting operation is complete. Additionally or alternatively, an audio signal or alert may be projected from a speaker at the user interface.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:
- a cabinet defining a chilled chamber;
- a defrost drawer housing mounted within the chilled chamber, the defrost drawer housing defining an enclosed defrost chamber for the receipt of a food item; and
- a pair of electromagnetic electrodes spaced apart along a vertical direction within the drawer housing, each electromagnetic electrode comprising
  - a first heating ring,
  - a second heating ring, the second heating ring being larger than the first heating ring,
  - a conductive path extending between the first heating ring and the second heating ring, and
  - an electrical restrictor element coupled to the conductive path and selectively permitting a current therethrough.

2. The refrigerator appliance of claim 1, wherein the electrical restrictor element is a gate switch.

3. The refrigerator appliance of claim 2, further comprising a controller operably coupled to the pair of electromagnetic electrodes, wherein the controller is configured to selectively close the gate switch based on a set heating size.

4. The refrigerator appliance of claim 1, wherein the electrical restrictor element is a narrow band pass filter.

5. The refrigerator appliance of claim 4, further comprising a controller operably coupled to the pair of electromagnetic electrodes, wherein the controller is configured to selectively adjust a frequency of the current based on a set heating size.

6. The refrigerator appliance of claim 1, further comprising a controller operably coupled to the pair of electromagnetic electrodes, wherein the controller is configured to selectively direct the current based on a received sizing signal.

7. The refrigerator appliance of claim 6, further comprising a user interface panel operably coupled to the controller, and wherein the received sizing signal is a user-selected input signal transmitted from the user interface.

8. The refrigerator appliance of claim 6, wherein the received sizing signal is an electrical field signal transmitted from the pair of electromagnetic electrodes.

9. The refrigerator appliance of claim 6, further comprising a secondary sizing sensor, and wherein the received sizing signal is transmitted from the secondary sizing sensor.

10. The refrigerator appliance of claim 1, wherein the first heating ring and the second heating ring are mutually-concentric.

11. The refrigerator appliance of claim 1, wherein the conductive path is a first conductive path, wherein the electrical restrictor element is a first electrical restrictor element, and wherein each electromagnetic heating ring further comprises a third heating ring, the third heating ring being larger than the second heating ring, a second conductive path extending between the second heating ring and the third heating ring, and a second electrical restrictor element coupled to the second conductive path and selectively permitting the current therethrough.

12. The refrigerator appliance of claim 11, wherein the first electrical restrictor element is a gate switch, and wherein the second electrical restrictor element is a narrow band pass filter.

13. A refrigerator appliance comprising:

a cabinet defining a chilled chamber;

a defrost drawer housing mounted within the chilled chamber, the defrost drawer housing defining an enclosed defrost chamber for the receipt of a food item;

a pair of electromagnetic electrodes spaced apart along a vertical direction within the drawer housing, each electromagnetic electrode comprising a first heating ring, a second heating ring positioned concentrically about the first heating ring, the second heating ring being larger than the first heating ring, a conductive path extending between the first heating ring and the second heating ring, and an electrical restrictor element coupled to the conductive path and selectively permitting a current therethrough; and a controller operably coupled to the pair of electromagnetic electrodes, wherein the controller is configured to direct the current through the electrical restrictor element based on a set heating size.

14. The refrigerator appliance of claim 13, wherein the electrical restrictor element is a gate switch, and wherein the controller is configured to selectively close the gate switch based on the set heating size.

15. The refrigerator appliance of claim 13, wherein the electrical restrictor element is a narrow band pass filter, wherein the controller is configured to selectively adjust a frequency of the current based on the set heating size.

16. The refrigerator appliance of claim 13, further comprising a user interface panel operably coupled to the controller, and wherein controller is configured to determine the set heating size based on is a user-selected input signal transmitted from the user interface.

17. The refrigerator appliance of claim 13, wherein controller is configured to determine the set heating size based an electrical field signal transmitted from the pair of electromagnetic electrodes.

18. The refrigerator appliance of claim 13, further comprising a secondary sizing sensor, and wherein controller is configured to determine the set heating size based a received sizing signal transmitted from the secondary sizing sensor.

19. The refrigerator appliance of claim 13, wherein the conductive path is a first conductive path, wherein the electrical restrictor element is a first electrical restrictor element, and wherein each electromagnetic heating ring further comprises a third heating ring, the third heating ring being larger than the second heating ring, a second conductive path extending between the second heating ring and the third heating ring, and a second electrical restrictor element coupled to the second conductive path and selectively permitting the current therethrough.

20. The refrigerator appliance of claim 19, wherein the first electrical restrictor element is a gate switch, wherein the second electrical restrictor element is a narrow band pass filter, and wherein the controller is configured to separately direct the current through each electrical restrictor element based on the set heating size.

* * * * *